US008173886B2

(12) United States Patent
Hashimoto

(10) Patent No.: US 8,173,886 B2
(45) Date of Patent: May 8, 2012

(54) ELECTRONIC PERCUSSION INSTRUMENT

(75) Inventor: Ryuji Hashimoto, Hamamatsu (JP)

(73) Assignee: Yamaha Corporation (JP)

( * ) Notice: Subject to any disclaimer, the term of this patent is extended or adjusted under 35 U.S.C. 154(b) by 5 days.

(21) Appl. No.: 12/402,479

(22) Filed: Mar. 11, 2009

(65) Prior Publication Data

US 2009/0229450 A1 Sep. 17, 2009

(30) Foreign Application Priority Data

Mar. 13, 2008 (JP) ..... 2008-064157

(51) Int. Cl.
*G10D 13/02* (2006.01)
*G10H 3/00* (2006.01)

(52) U.S. Cl. ..... 84/723; 84/411 R

(58) Field of Classification Search ..... 84/411 R, 84/734, 723, 743
See application file for complete search history.

(56) References Cited

U.S. PATENT DOCUMENTS 4,679,479 A * 7/1987 Koyamato ..... 84/743
6,784,352 B2 * 8/2004 Suenaga ..... 84/411 R
6,822,148 B2 * 11/2004 Yanase ..... 84/422.1
7,038,117 B2 * 5/2006 Yoshino ..... 84/411 R
7,135,630 B2 * 11/2006 Maruhashi et al. ..... 84/411 P
7,396,991 B2 * 7/2008 Susami ..... 84/615
2007/0234886 A1 * 10/2007 Matsuyuki et al. ..... 84/723

FOREIGN PATENT DOCUMENTS

JP 6-175651 A 6/1994

* cited by examiner

*Primary Examiner* — Elvin G Enad
*Assistant Examiner* — Andrew R Millikin
(74) *Attorney, Agent, or Firm* — Rossi, Kimms & McDowell LLP

(57) ABSTRACT

A baseplate carries on its surface a pad constituting a strike surface and a tubular rim surrounding the pad and constituting a strike ring. A pad sensor is provided on the surface of the baseplate in the central area thereof for detecting the vibration of the baseplate caused by a strike on the pad, and a rim sensor is provided between the rim and the baseplate for detecting the vibration of the rim. The electric signals representing the detected vibrations trigger the generation of tone signals of drum sounds. The baseplate is supported via vibration absorber pieces on a support frame. Thus, disturbing vibrations externally given to the support frame will be prevented from propagating up to the baseplate, being absorbed by the vibration absorber pieces.

4 Claims, 6 Drawing Sheets

ELECTRONIC PERCUSSION INSTRUMENT

TECHNICAL FIELD

The present invention relates to an electronic percussion musical instrument such as an electronic drum which detects vibrations caused by the strikes onto the pad or the rim of the drum and generates musical tones based on the signals of the detected vibrations, in which undesirable external noise vibrations will not be picked up to cause undesirable tone generation.

BACKGROUND INFORMATION

In an electronic drum which is a kind of conventional electronic percussion musical instruments, the vibrations caused by striking the pad surface or the rim of the electronic drum are detected by the sensor provided under the pad or on the rim, and the detection output signals trigger the generation of musical tones for drum sounds. A conventional electronic drum comprises, as shown in unexamined Japanese patent publication No. H6-175651, a shallow pan-shaped body frame made of hard rubber or the like material and a baseplate made of iron and fixed to the bottom of the body frame, the body frame and the baseplate being together supported by a base member. In the pad rubber constituting the strike surface is embedded a pad plate, which in turn is supported by the baseplate by means of a cushion member in a doughnut (ring) shape. On the under surface of the pad plate is attached a pad sensor. In the peripheral area of the body frame is embedded a rim plate with a rim sensor attached to the inner wall of the rim plate. When a player strikes the pad rubber of the electronic drum of the above-mentioned structure, the pad plate vibrates and the vibration will be detected or picked up by the pad sensor. When the player gives a rim shot, the rim plate vibrates upon strike on the rim by the player, and the vibration will be detected by the rim sensor. In this structure, the pad plate is not in direct contact with the rim, but in indirect contact with the rim via the pad rubber, in which the pad rubber attenuates the propagation therethrough of the vibration from the rim, as the pad rubber is made of a rubber material which is softer than the rubber of the rim. Thus, the vibration of the rim plate will not reach the pad sensor. Consequently, the pad sensor and the rim sensor separately detects the respective vibrations as electric signals, which in turn pass through the electric circuit, the amplifier and the loudspeaker to be amplified electrically and emitted as musical sounds.

In such an electronic drum of a conventional structure, however, when external noises (disturbances) of vibration are transmitted from the floor or else to the base member, the vibration of the base member will not propagate through the cushion member to the pad plate, being absorbed in the cushion member. On the other hand, as the rim is made integral with the body frame which is directly supported by the base member, the disturbing noise vibrations transmitted to the base member will be further transmitted to the body frame and the rim and will be detected or picked up by the rim sensor. Such has been a drawback with the conventional electronic drum.

SUMMARY OF THE INVENTION

In view of the foregoing circumstances, therefore, it is a primary object of the present invention to obviate the above-mentioned drawback residing in the conventional electronic drum and to provide an electronic percussion musical instrument, in which the vibration sensors for detecting strikes onto the electronic drum will not pick up the disturbing vibrations transmitted even up to the supporting frame.

According to the present invention, the object is accomplished by providing an electronic percussion instrument comprising: a baseplate; a pad provided on the baseplate for constituting a strike surface; a rim provided on the peripheral area of the baseplate; a pad sensor and a rim sensor arranged on the baseplate for detecting a strike on the pad and a strike on the rim; a support frame for supporting the baseplate; and a vibration absorbing piece provided between the support frame and the baseplate so that the baseplate is supported by the support frame via the vibration absorbing piece.

As the sensor for detecting the vibrations of the pad and the rim is provided on the baseplate and the baseplate is supported on the support frame via the vibration absorbing piece, disturbing vibrations transmitted externally, for example, from the floor to the support frame will be absorbed while propagating through the vibration absorbing piece and will not reach the baseplate to be detected by the sensor. This will allow the use of a sensor of an enhanced sensitivity without picking up undesirable noises caused externally, and the dynamic range of the sensor can be broadened.

BRIEF DESCRIPTION OF THE DRAWINGS

For a better understanding of the present invention, and to show how the same may be practiced and will work, reference will now be made, by way of example, to the accompanying drawings, in which.

DETAILED DESCRIPTION OF EMBODIMENTS OF THE INVENTION

Figure 1:
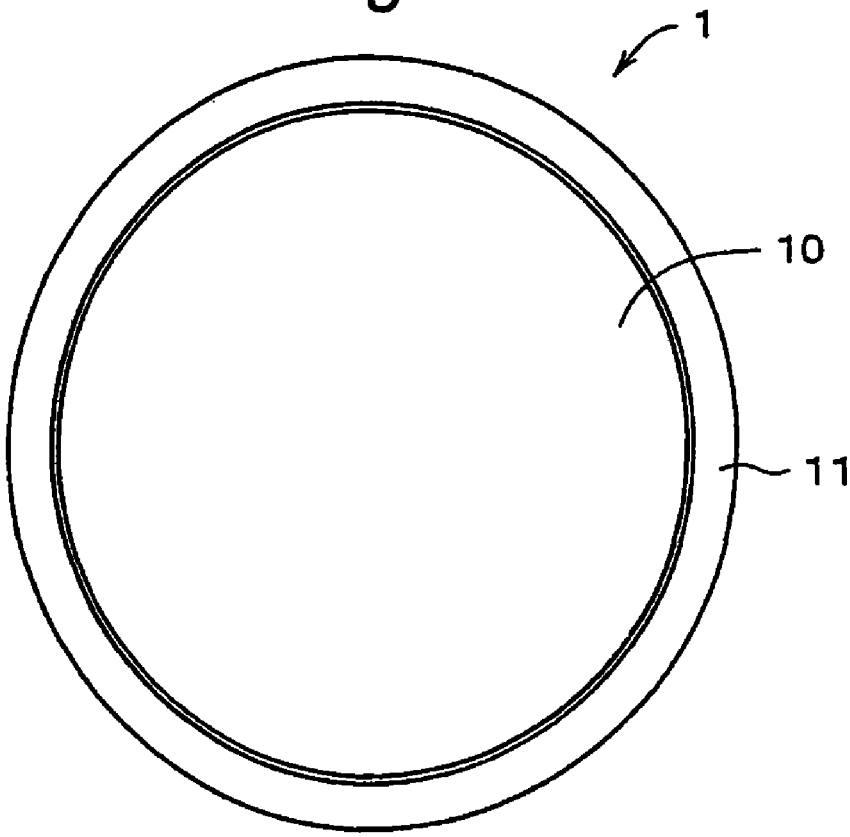
FIG. 1 is a plan view of an electronic percussion instrument according to a first embodiment of the present invention.

The invention and its various embodiments can now be better understood by turning to the following detailed description of the preferred embodiments with reference to the accompanying drawings.

It should be expressly understood that the illustrated embodiments are presented just as practicable examples of the invention and that the invention as defined by the claims may be broader than the illustrated embodiments described below. In the drawing, like reference characters refer to like parts so that repetitive explanations may be omitted.

Figure 2:
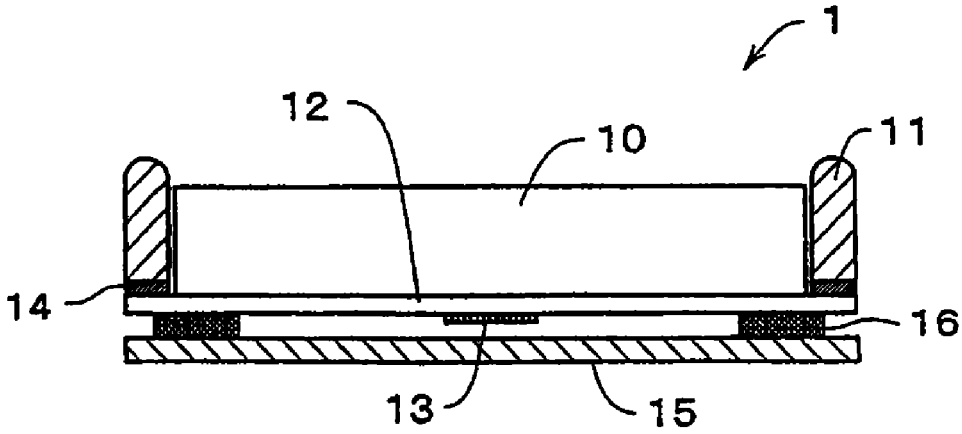
FIG. 2 is a side view of the first embodiment.
Figure 3:
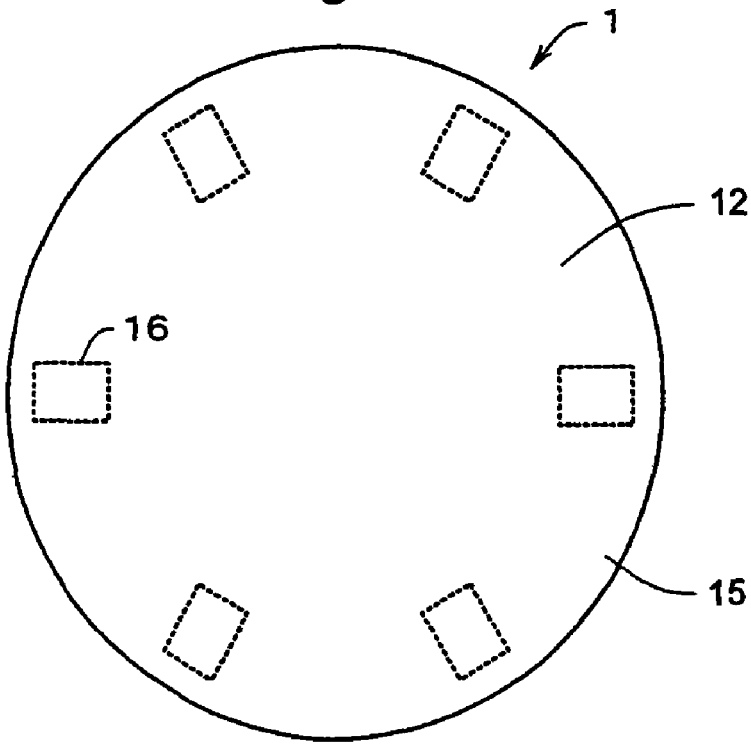
FIG. 3 is a bottom view of the first embodiment.
Figure 4:
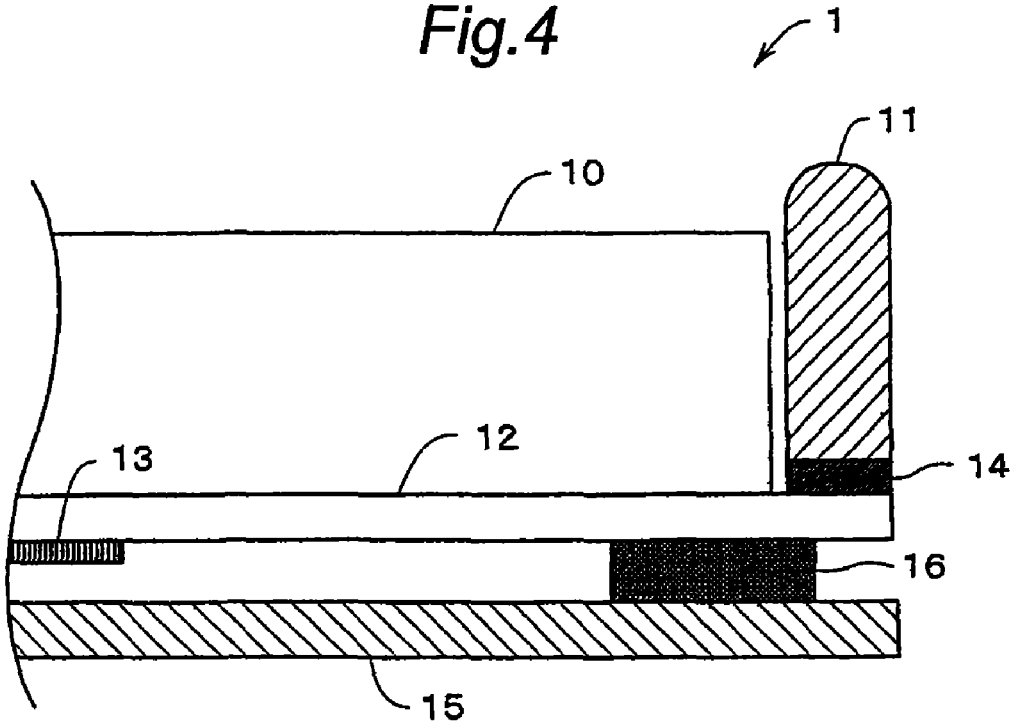
FIG. 4 is an enlarged fragmentary side view of the first embodiment.

The structure of an electronic drum as a first embodiment of an electronic percussion instrument according to the present invention is shown in FIGS. 1-4, in which FIG. 1 shows the plan view thereof, FIG. 2 the side view mainly in cross section, FIG. 3 the bottom view and FIG. 4 a fragmentary side view as enlarged from FIG. 2.

As shown in FIGS. 1-4, an electronic drum 1 comprises a pad 10 formed from a foamed plastic material or the like to constitute a strike surface for the player, which is fixed on the upper surface of a baseplate 12 made of an iron flat plate or the like member. The baseplate 12 is circular in shape and the pad 10 is also circular in shape in the plan view with a bit smaller diameter than the baseplate 12 and rectangular in vertical cross section having a larger thickness than the baseplate 12. In the central area of the baseplate 12 is arranged a pad sensor 13 such as a piezoelectric sensor on the lower surface (underside) of the baseplate 12 for detecting the player's strikes on the pad 10. In the peripheral area of the baseplate 12 is provided a rim 11 in the shape of a circular tube, being fixed on to the upper surface of the baseplate 12 via a rim sensor 14. The rim 11 is made of metal or else, surrounding the pad 10. The rim sensor 14 is in the shape of a ring to match the bottom end of the rim 11, and is made of, for example, an electrostatic pressure sensor constituted by laminated plastic films formed with electrodes thereon.

In the peripheral area of the baseplate 12 a plurality of vibration absorber pieces 16 are fixed to the lower surface of the baseplate 12, which vibration absorber pieces 16 are in turn fixed to the upper surface of a support frame 15 having the shape of a circular plate Six vibration absorber pieces 16, each having the shape of a rectangular solid, are fixed on the lower surface of the baseplate 12 at an angular spacing of 60 degrees as shown in FIGS. 2, 3 and 4, while the number of pieces 16 is not necessarily limited to six but may be any other number as long as there are three or more of the pieces 16. The support frame 15 may be made of metal or wood, and the vibration absorber pieces 16 may be made of soft silicone rubber sponge or the like. The more the pieces 16 are provided, the smaller the hardness of the pieces 16 may be. The shape of the vibration absorber pieces 16 may be in the shape of a circular cylinder, a polygonal cylinder, or a tubular ring.

With the electronic drum 1 of the first embodiment having a structure as described above, when the player strikes the strike surface of the pad 10 using a beating stick, the pad 10 will vibrate in response to the strike and the vibration having an amplitude according to the strength of the strike will be applied to the pad sensor 13, which in turn will output a sensed strike signal having an amplitude according to the strength of the strike. On the other hand, when the player performs a rim shot, the player strikes the rim 11, the rim 11 vibrates upon strike and the vibration will be picked up by the rim sensor 14. The output signals from the pad sensor 13 and the rim sensor 14 will be applied to a tone generator circuit, although not shown, to trigger the same to generate tone signals for a drum performance or a rim shot performance.

Sometimes disturbing vibrations may be transmitted through the floor and then to the support frame 15. Particularly in the case of a drum set performance, the support frame 15 of a drum may receive a vibration caused by a strike on another drum and transmitted through the floor. In the electronic drum 1 of the first embodiment of the invention, however, the vibration absorber pieces 16 provided between the support frame 15 and the baseplate 12 on which the pad sensor 13 and the rim sensor 14 are fixed will absorb the vibrations transmitted up to the support frame 15, and accordingly the vibrations in the support frame 15 will no longer be transmitted to the baseplate 12. This will provide an electronic drum 1 which is tough or robust against disturbance, and accordingly the sensitivity of the pad sensor 13 or the rim sensor 14 can be increased, which in turn will increase the dynamic range of the electronic drum 1.

Figure 5:
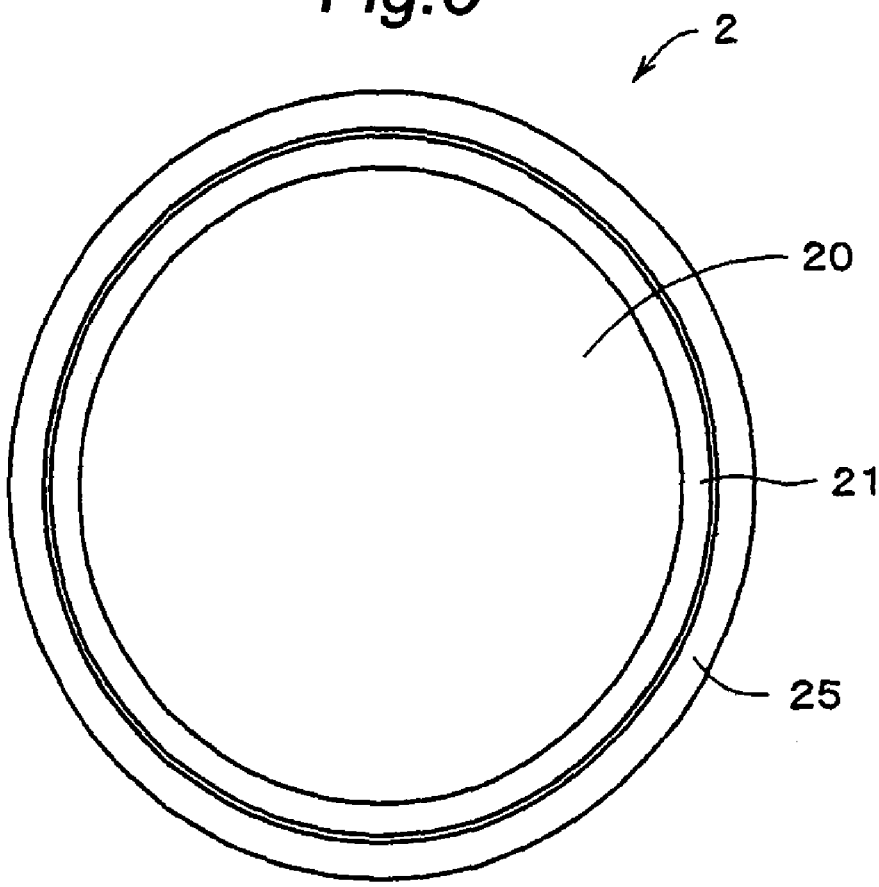
FIG. 5 is a plan view of an electronic percussion instrument according to a second embodiment of the present invention.
Figure 6:
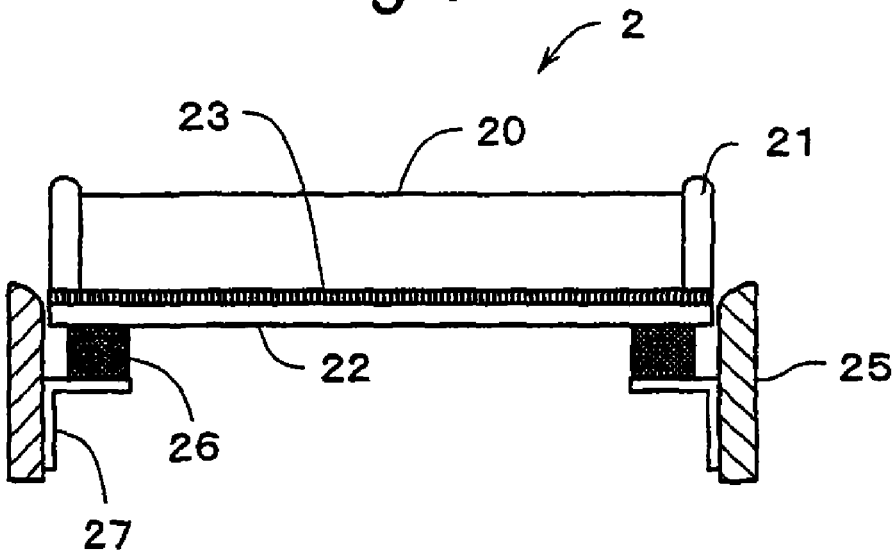
FIG. 6 is a side view of the second embodiment.
Figure 7:
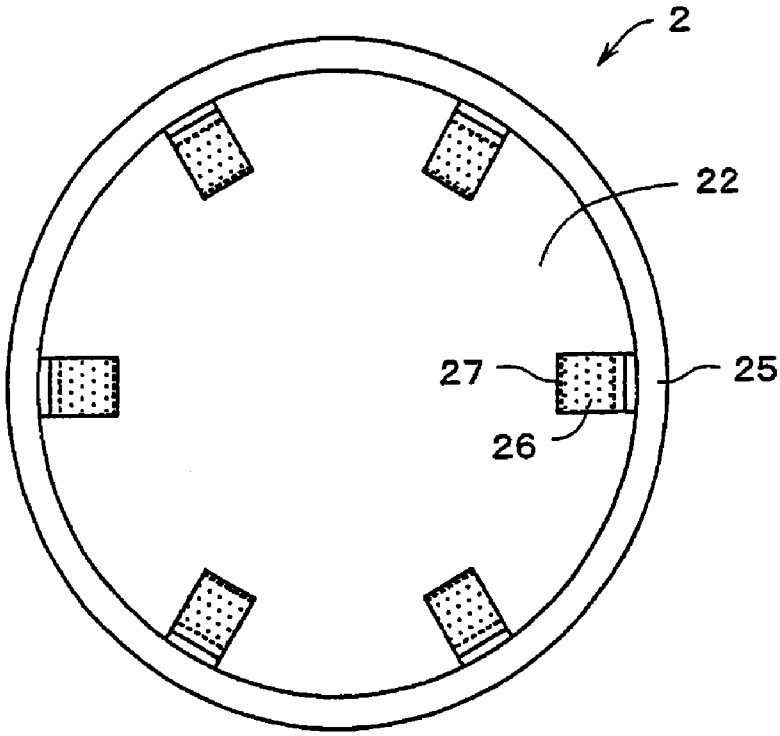
FIG. 7 is a bottom view of the second embodiment.
Figure 8:
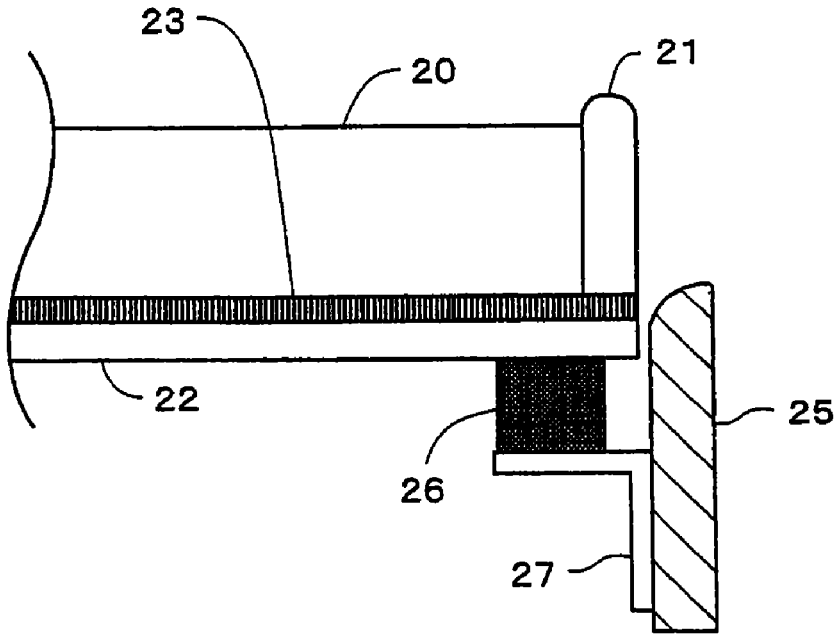
FIG. 8 is an enlarged fragmentary side view of the second embodiment.

The structure of an electronic drum as a second embodiment of an electronic percussion instrument according to the present invention is shown in FIGS. 5-8, in which FIG. 5 shows the plan view thereof, FIG. 6 the side view mainly in cross section, FIG. 7 the bottom view and FIG. 8 a fragmentary side view as enlarged from FIG. 6.

As shown in FIGS. 5-8, an electronic drum 2 comprises a pad 20 formed from a foamed plastic material or the like to constitute a strike surface for the player, which is fixed on the upper surface of a baseplate 22 made of an iron flat plate or the like member sandwiching a sensor 23 in the shape of a membrane between the pad 20 and the baseplate 22. The baseplate 22 is circular in shape and the pad 20 is also circular in shape in the plan view with a bit smaller diameter than the baseplate 22 and rectangular in vertical cross section having a larger thickness than the baseplate 22. The sensor 23 is made of, for example, an electrostatic pressure sensor constituted by laminated plastic films formed with electrodes thereon and is circular in shape having approximately the same size as the baseplate 22 and provided over the almost entire surface of the baseplate 22. In the peripheral area of the baseplate 22 is provided a rim 21 in the shape of a circular tube, being fixed on to the upper surface of the baseplate 22 via the film sensor 23. The rim 21 is made of metal or else, surrounding the pad 20. The sensor 23 is to detect the strikes on to the pad 20 and the rim 21 in common.

In the peripheral area of the baseplate 22 a plurality of vibration absorber pieces 26 are fixed to the lower surface of the baseplate 22. A support frame 25 having the shape of a circular tube is provided with a plurality of L-shaped brackets 27 on the inner surface of the tubular support frame 25. The lower surfaces of the vibration absorber pieces 26 are fixed to the upper surfaces of the horizontal arms of the L-shaped brackets 27, respectively. Thus, each of the vibration absorber pieces 26 is sandwiched between the baseplate 22 and the horizontal arm of the L-shaped bracket 27 which is fixed to the support frame 25. In FIG. 7, there are six vibration absorber pieces 26 fixed on the lower surface of the baseplate 22 at an angular spacing of 60 degrees, while the number of pieces 26 is not necessarily limited to six but may be any other number as long as there are three or more of the pieces 26. Thus the baseplate 22 is supported by the support frame 25 via the vibration absorber pieces 26. The vibration absorber pieces 26 may be made of soft silicone rubber sponge or the like. The more the pieces 26 are provided, the smaller the hardness of the pieces 26 may be. While the shape of the vibration absorber piece 26 is a rectangular solid in the shown embodiment, the shape of the vibration absorber pieces 26 may be in the shape of a circular cylinder or a polygonal cylinder.

With the electronic drum 2 of the second embodiment having a structure as described above, when the player strikes the strike surface of the pad 20 using a beating stick, the strike dents the pad 20 to give the sensor 23 a pressure according to the strength of the strike. Consequently the sensor 23 outputs a sensed strike signal having an amplitude according to the strength of the strike applied on the pad 20. On the other hand, when the player performs a rim shot, the player strikes the rim 21, the rim 21 vibrates upon strike and the vibration will be picked up by the sensor 23. The sensor 23 outputs a sensed strike signal according to the position at which the sensor 23 detects the strike or the vibration, the strike signal according to the position indicating whether the pad 20 has been struck or the rim 21 has been struck. The output signals from the sensor 23 indicating the strikes on the pad 20 or on the rim will be applied to a tone generator circuit, although not shown, to trigger the same to generate tone signals for a drum performance or a rim shot performance.

Sometimes disturbing vibrations may be transmitted through the floor and then to the support frame 25. Particularly in the case of a drum set performance, the support frame 25 of a drum may receive a vibration caused by a strike on another drum and transmitted through the floor. In the electronic drum 2 of the second embodiment of the invention, however, the vibration absorber pieces 26 provided between the baseplate 22 and the support frame 25 by means of the L-shaped bracket 27 will absorb the vibrations transmitted up to the support frame 25, and accordingly the vibrations in the support frame 25 will no longer transmitted to the baseplate 22. This will provide an electronic drum 2 which is tough or robust against disturbance, and accordingly the sensitivity of the sensor 23 can be increased, which in turn will increase the dynamic range of the electronic drum 2.

Figure 9:
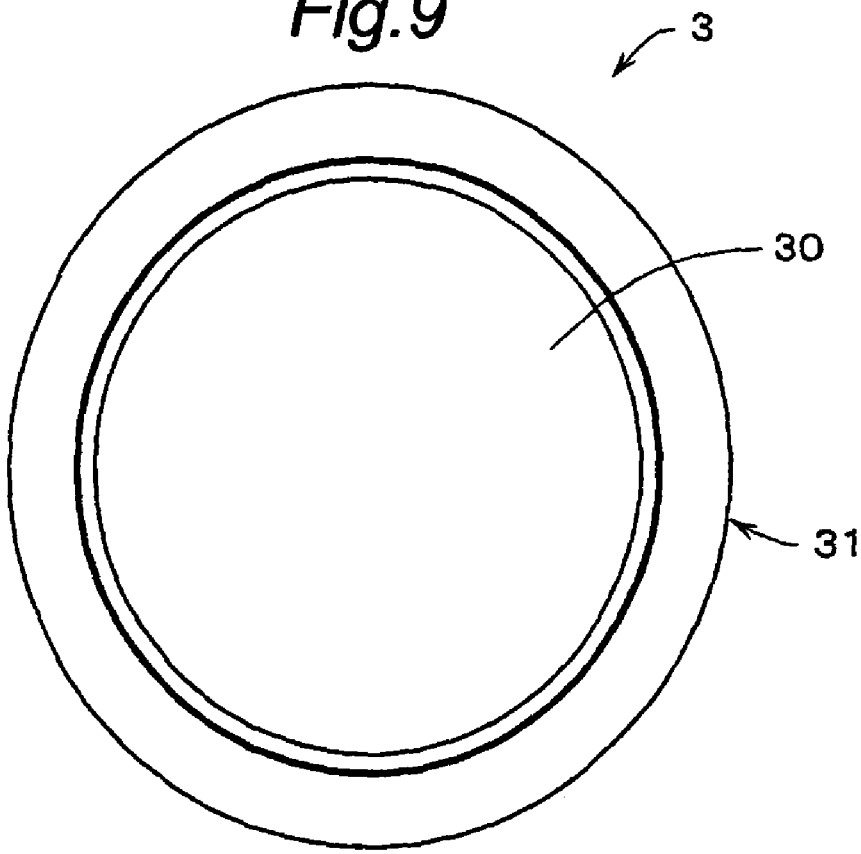
FIG. 9 is a plan view of an electronic percussion instrument according to a third embodiment of the present invention.
Figure 10:
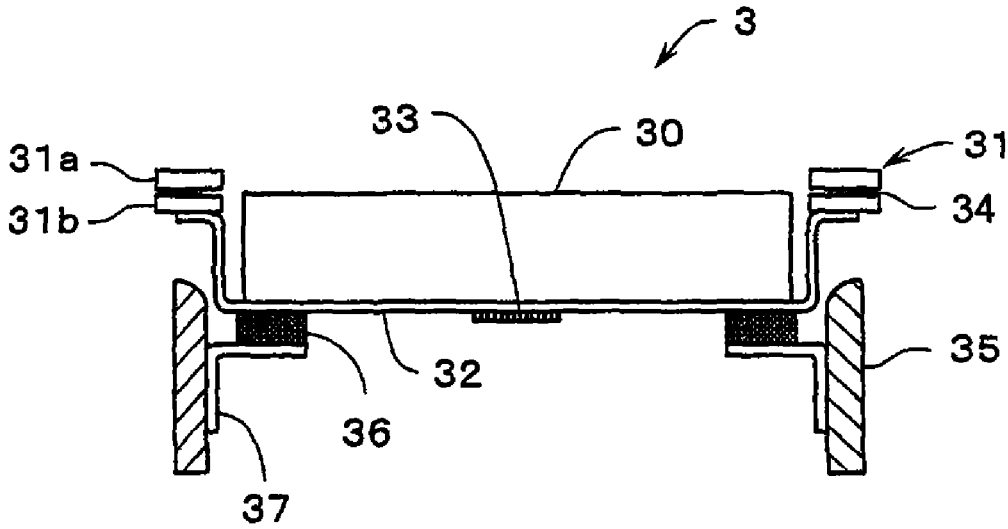
FIG. 10 is a side view of the third embodiment.
Figure 11:
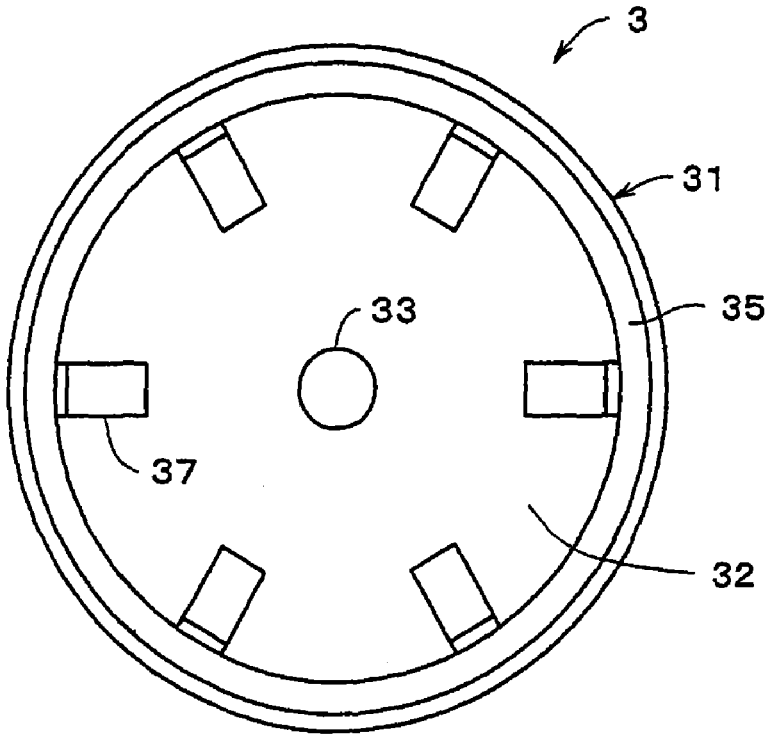
FIG. 11 is a bottom view of the third embodiment.
Figure 12:
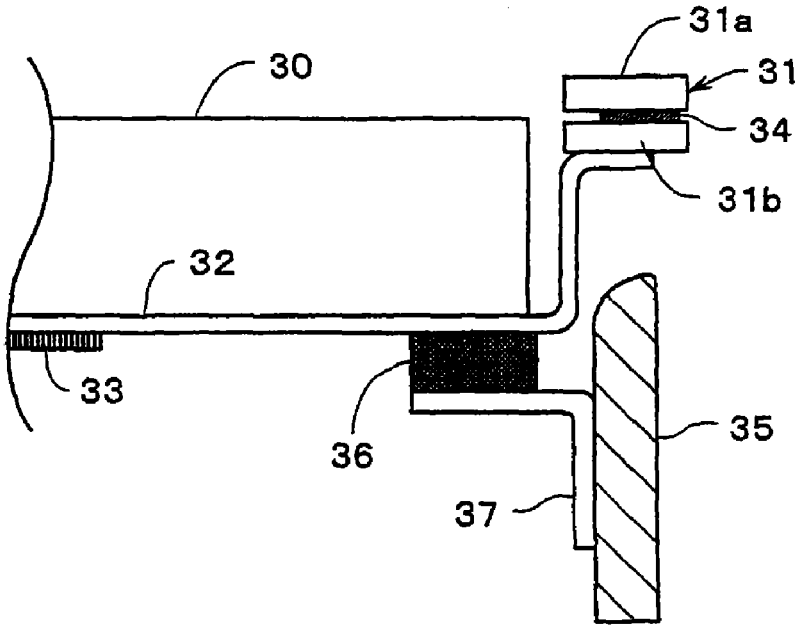
FIG. 12 is an enlarged fragmentary side view of the third embodiment.

The structure of an electronic drum as a third embodiment of an electronic percussion instrument according to the present invention is shown in FIGS. 9-12, in which FIG. 9 shows the plan view thereof, FIG. 10 the side view mainly in cross section, FIG. 11 the bottom view and FIG. 12 a fragmentary side view as enlarged from FIG. 10.

As shown in FIGS. 9-12, an electronic drum 3 comprises a pad 30 formed from a foamed plastic material or the like to constitute a strike surface for the player, which is fixed on the upper surface of a baseplate 32 made of a shaped iron sheet or the like member. The baseplate 32 has a circular flat bottom, a tubular vertical wall and a flange in the peripheral area integrally forming a pan-shape, and the pad 30 accommodated in the space of the pan-shaped baseplate 32 is also circular in shape in the plan view with a bit smaller diameter than the bottom portion of the baseplate 32 and rectangular in vertical cross section having a larger thickness than the baseplate 32. In the central area of the baseplate 32 is arranged a pad sensor 33 such as a piezoelectric sensor on the lower surface (underside) of the baseplate 32 for detecting the player's strikes on the pad 30. The peripheral portion of the baseplate 32 is bent upward to form a vertical wall surrounding the pad 32 and further bent outward to form a horizontal flange, on which is fixed a rim 31 comprised of a ring-shaped upper rim member 31*a* made of metal or the like, a ring-shaped lower rim member 31*b* also made of metal or the like, and a rim sensor 34 sandwiched between the upper rim member 31*a* and the lower rim member 31*b*, the three being laminated together. The rim sensor 34 is in the shape of a ring to match the upper and lower rim members 31*a* and 31*b*, and is made of, for example, an electrostatic pressure sensor constituted by laminated plastic films formed with electrodes thereon.

In the peripheral area of the bottom portion of the baseplate 32 a plurality of vibration absorber pieces 36 are fixed to the lower surface of the bottom portion of the baseplate 32. A support frame 35 having the shape of a circular tube is provided with a plurality of L-shaped brackets 37 on the inner surface of the tubular support frame 35. The lower surfaces of the vibration absorber pieces 36 are fixed to the upper surfaces of the horizontal arms of the L-shaped brackets 37, respectively. Thus, each of the vibration absorber pieces 36 is sandwiched between the bottom of the baseplate 32 and the horizontal arm of the L-shaped bracket 37 which is fixed to the support frame 35. In FIG. 11, there are six vibration absorber pieces 36 fixed on the lower surface of the bottom of the baseplate 32 at an angular spacing of 60 degrees, while the number of pieces 36 is not necessarily limited to six but may be any other number as long as there are three or more of the absorber pieces 36. Thus the baseplate 32 is supported by the support frame 35 via the vibration absorber pieces 36. The vibration absorber pieces 36 may be made of soft silicone rubber sponge or the like. The more the pieces 36 are provided, the smaller the hardness of the pieces 36 may be. While the shape of the vibration absorber piece 36 is a rectangular solid in the shown embodiment, the shape of the vibration absorber pieces 36 may be in the shape of a circular cylinder or a polygonal cylinder.

With the electronic drum 3 of the third embodiment having a structure as described above, when the player strikes the strike surface of the pad 30 using a beating stick, the pad 30 will vibrate in response to the strike and the vibration having an amplitude according to the strength of the strike will be applied to the pad sensor 33, which in turn will output a sensed strike signal having an amplitude according to the strength of the strike. On the other hand, when the player performs a rim shot, the player strikes the rim 31, the rim 31 vibrates upon strike and the vibration will be picked up by the rim sensor 34. The output signals from the pad sensor 33 and the rim sensor 34 will be applied to a tone generator circuit, although not shown, to trigger the same to generate tone signals for a drum performance or a rim shot performance.

Sometimes disturbing vibrations may be transmitted through the floor and then to the support frame 35. Particularly in the case of a drum set performance, the support frame 35 of a drum may receive a vibration caused by a strike on another drum and transmitted through the floor. In the electronic drum 3 of the third embodiment of the invention, however, the vibration absorber pieces 36 provided, by means of the L-shaped bracket 37, between the support frame 35 and the baseplate 32 on which the pad sensor 33 and the rim sensor 34 are fixed will absorb the vibrations transmitted up to the support frame 35, and accordingly the vibrations in the support frame 35 will no longer be transmitted to the baseplate 32. This will provide an electronic drum 3 which is tough or robust against disturbance, and accordingly the sensitivity of the pad sensor 33 or the rim sensor 34 can be increased, which in turn will increase the dynamic range of the electronic drum 3.

In an electronic drum according to the present invention, in order to prevent vibrations of the floor in higher frequencies from reaching the baseplate through the support frame, mechanical filters may be employed to suspend the support frame.

While several electronic drums have been described and illustrated, as preferred embodiments, in detail herein above with reference to the drawings, the present invention should not be interpreted to be limited to electronic drums, but can be applied also to other types of electronic percussion instruments such as electronic cymbals. Where the electronic percussion instrument according to the present invention is embodied in an electronic drum having a baseplate supported over the support frame by means of vibration absorber pieces in a layer structure, this structure is applicable in a drum set to each of the electronic drums constituting the drum set, or in a multi-pad electronic drum comprising a plurality of electronic drums carried on a single support frame. It should be understood that the illustrated embodiments are just for preferable examples and that the present invention can be practiced with various modifications without departing from the spirit of the present invention.

What is claimed is:

1. An electronic percussion instrument comprising:

a baseplate having an upper surface, a lower surface, and a peripheral area;

a pad provided on the upper surface of the baseplate and constituting a strike surface;

a pad sensor arranged on the lower surface of the baseplate for detecting a strike on the pad;

a rim provided on the peripheral area of the baseplate;

a rim sensor arranged on the baseplate for detecting a strike on the rim;

a support frame for supporting the baseplate; and a vibration absorbing piece provided between the support frame and the baseplate so that the baseplate is supported by the support frame via the vibration absorbing piece.

2. An electronic percussion instrument as claimed in claim 1, wherein the rim is of a laminated structure including a lower rim member and an upper rim member, and having the rim sensor arranged between the lower rim member and the upper rim member.

3. An electronic percussion instrument comprising:

a baseplate having an upper surface, a lower surface, and a peripheral area;

a sensor for detecting vibration, wherein the sensor has an upper face, a lower face, and a peripheral area, and the lower face of the sensor is provided on the upper surface of the baseplate;

a pad provided on the upper face of the sensor and constituting a strike surface;

a rim provided on the peripheral area of the sensor, wherein the peripheral area of the sensor is sandwiched between the rim and the baseplate;

a support frame for supporting the baseplate; and a vibration absorbing piece provided between the support frame and the baseplate so that the baseplate is supported by the support frame via the vibration absorbing piece, wherein the sensor detects vibration caused by a strike on the pad and a strike on the rim.

4. An electronic percussion instrument according to claim 3, wherein the sensor is approximately the same size as the baseplate.

* * * * *